US008123382B2

(12) United States Patent
Patrick et al.

(10) Patent No.: US 8,123,382 B2
(45) Date of Patent: Feb. 28, 2012

(54) MODULAR EXTRUDED HEAT SINK

(75) Inventors: Ellis W. Patrick, Sharpsburg, GA (US); Evans Edward Thompson, III, Fairburn, GA (US)

(73) Assignee: Cooper Technologies Company, Houston, TX (US)

( * ) Notice: Subject to any disclaimer, the term of this patent is extended or adjusted under 35 U.S.C. 154(b) by 250 days.

(21) Appl. No.: 12/471,575

(22) Filed: May 26, 2009

(65) Prior Publication Data

US 2010/0091495 A1 Apr. 15, 2010

Related U.S. Application Data

(60) Provisional application No. 61/104,444, filed on Oct. 10, 2008.

(51) Int. Cl.
*F21V 29/00* (2006.01)

(52) U.S. Cl. ..... 362/294; 362/218; 362/249.02

(58) Field of Classification Search ..... 362/218, 362/294, 373, 249.02; 361/709, 710
See application file for complete search history.

(56) References Cited

U.S. PATENT DOCUMENTS

| | | | | |
|---|---|---|---|---|
| 1,447,238 | A | 3/1923 | Crownfield | |
| 1,711,478 | A | 4/1929 | Cromwell | |
| 4,271,408 | A | 6/1981 | Teshima et al. | |
| 5,586,004 | A * | 12/1996 | Green et al. | 361/709 |
| 5,673,997 | A | 10/1997 | Akiyama | |
| 5,826,970 | A | 10/1998 | Keller et al. | |
| 6,343,871 | B1 | 2/2002 | Yu | |
| 6,448,900 | B1 | 9/2002 | Chen | |
| 6,547,417 | B2 | 4/2003 | Lee | |
| 6,561,690 | B2 | 5/2003 | Balestriero et al. | |
| 6,578,983 | B2 | 6/2003 | Holten | |
| 6,636,003 | B2 | 10/2003 | Rahm et al. | |
| 6,682,211 | B2 | 1/2004 | English et al. | |
| 6,853,151 | B2 | 2/2005 | Leong et al. | |
| 6,976,769 | B2 | 12/2005 | McCullough et al. | |
| 7,014,337 | B2 | 3/2006 | Chen | |
| 7,048,412 | B2 | 5/2006 | Martin et al. | |
| 7,144,135 | B2 | 12/2006 | Martin et al. | |
| 7,242,028 | B2 | 7/2007 | Dry | |
| 7,288,796 | B2 * | 10/2007 | Dry | 362/218 |
| 7,440,280 | B2 | 10/2008 | Shuy | |
| 7,443,678 | B2 * | 10/2008 | Han et al. | 361/709 |
| 7,568,817 | B2 | 8/2009 | Lee et al. | |
| 7,593,229 | B2 | 9/2009 | Shuy | |
| 7,641,361 | B2 | 1/2010 | Wedell et al. | |
| 7,651,253 | B2 | 1/2010 | Shuy | |
| 7,748,876 | B2 | 7/2010 | Zhang et al. | |
| 2008/0002399 | A1 | 1/2008 | Villard et al. | |
| 2008/0316755 | A1 | 12/2008 | Zheng et al. | |
| 2009/0021944 | A1 | 1/2009 | Lee et al. | |

(Continued)

*Primary Examiner* — Y My Quach Lee
(74) *Attorney, Agent, or Firm* — King & Spalding LLP

(57) ABSTRACT

A modular heat sink includes one or more heat sink sections interconnected sequentially to each other to form a polar array. Each heat sink section includes a first connecting part and a second connecting part, where the first connecting part is configured to couple with the second connecting part of another heat sink section. Once assembled, the modular heat sink includes a channel formed substantially through the center of the modular heat sink. Each heat sink section is manufactured using an extrusion process. The assembled modular heat sink has one or more hollow portions within the overall shape that cannot be fabricated in a single extrusion process. One or more LEDs are coupled to the outer surface of the modular heat sink. The modular heat sink, with LEDs coupled thereto, is coupled to a wireway tube and mounted to a post-top light fixture to form an LED luminaire.

19 Claims, 7 Drawing Sheets

U.S. PATENT DOCUMENTS

2009/0040759 A1 2/2009 Zhang et al.
2009/0073589 A1 3/2009 Patrick et al.
2009/0073688 A1 3/2009 Patrick
2009/0080189 A1 3/2009 Wegner
2009/0086476 A1 4/2009 Tickner et al.
2009/0086481 A1 4/2009 Wegner
2009/0129086 A1 5/2009 Thompson
2009/0244896 A1 10/2009 McGehee et al.
2009/0262530 A1 10/2009 Tickner et al.
2010/0091507 A1* 4/2010 Li et al. ..... 362/294
2010/0208460 A1 8/2010 Ladewig et al.

* cited by examiner

MODULAR EXTRUDED HEAT SINK

CROSS REFERENCE TO RELATED APPLICATIONS

The present application claims priority from U.S. Provisional Patent Application No. 61/104,444, entitled "Light Emitting Diode Post Top Light Fixture" and filed on Oct. 10, 2008.

TECHNICAL FIELD

The present invention relates generally to heat sinks, and more particularly, to a modular heat sink for removing heat from electronic components such as light emitting diode ("LED") components.

BACKGROUND

LEDs are widely used in various applications including, but not limited to, area lighting, indoor lighting, and backlighting. LEDs are more efficient at generating visible light than many traditional light sources. However, the implementation of LEDs for many traditional light source applications has been hindered by the amount of heat build-up occurring within the electronic circuits of the LEDs. Heat build-up reduces the LEDs light output, shortens the LEDs lifespan and can eventually cause LEDs to fail.

Heat sinks are being used with LEDs and provide a pathway for absorbing the heat generated from the LEDs and for dissipating the heat directly or radiantly to the surrounding environment. Exemplary methods for manufacturing heat sinks include the casting process and the extrusion process. The casting process involves a series of steps including building a mold with specific dimensions and allowances, melting a base metal and adding a degasser component, machining the heat sink to obtain the proper dimensions, and polishing to provide a finish to the surface. The extrusion process, however, involves pushing or drawing a material through a die of the desired cross-section. Exemplary materials that can be extruded include, but are not limited to, metals, such as aluminum, copper, lead, tin, magnesium, zinc, steel, and titanium, polymers, and ceramics.

The extrusion process provides several benefits over other manufacturing processes. The extrusion process is capable of creating very complex cross-sections. The extrusion process also is able to work materials that are brittle because the material only encounters compressive and shear stresses. The process further forms finished parts having an excellent surface finish. The extrusion process also is more cost effective than other manufacturing processes.

One limitation when using an extrusion process to form a heat sink is that hollows cannot be formed without machining the heat sink to produce the hollow once the material has been extruded. A hollow is an area in the interior of the extruded product that is devoid of material but otherwise surrounded by the extruded material. Thus, an extra more costly step is involved to form the hollow within the extruded material or the hollow can be formed using the more costly casting process.

In view of the foregoing, there is a need in the art for providing a modular heat sink. There is a further need in the art for providing a modularly extruded heat sink that can be interconnected to form a shape that cannot be formed by directly from the extrusion process. Furthermore, there is a need for providing a method to form heat sink shapes having a hollow during the extrusion process.

SUMMARY

In one exemplary embodiment, the modular heat sink includes one or more heat sink sections that are interconnected sequentially to each other. The heat sink sections form a polar array once assembled. Each heat sink section includes a base having a first connecting part at one end and a second connecting part at an opposing end. The first connecting part of each heat sink section is interconnected with the second connecting part of an adjacent heat sink section.

In another exemplary embodiment, the LED mounting structure includes a modular heat sink and one or more LEDs coupled to the outer surface of the modular heat sink. The modular heat sink includes one or more heat sink sections that are interconnected sequentially to each other. The heat sink sections form a polar array once assembled. Each heat sink section includes a base having a first connecting part at one end and a second connecting part at an opposing end. The first connecting part of each heat sink section is interconnected with the second connecting part of an adjacent heat sink section.

In another exemplary embodiment, a method for forming a modular heat sink includes extruding a plurality of heat sink sections and interconnecting each of the heat sink sections together to form the modular heat sink. The modular heat sink is formed in a polar array. Each heat sink section has a first connecting part and a second connecting part, wherein the first connecting part is configured to couple with the second connecting part.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1:
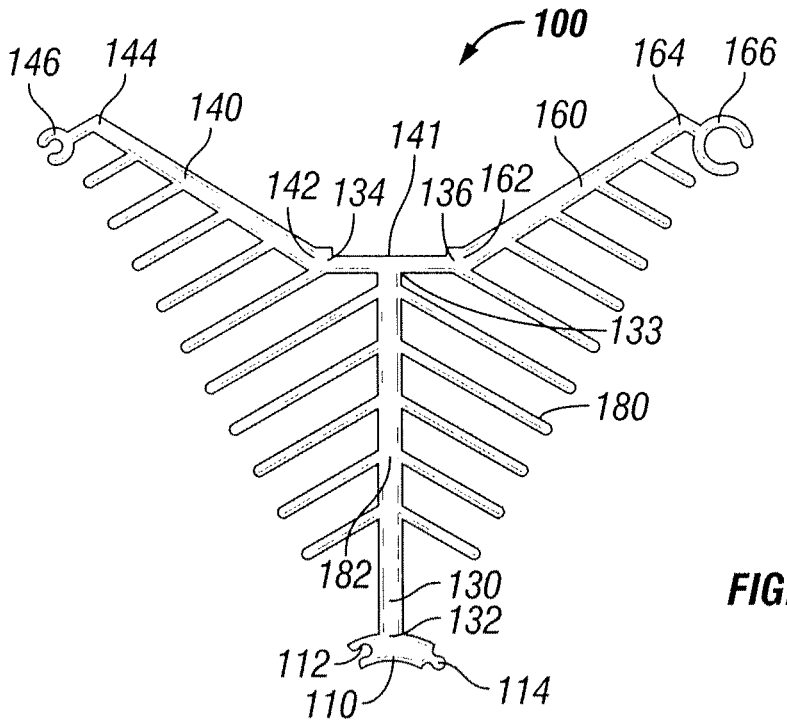
FIG. 1 is a top view of a heat sink section in accordance with an exemplary embodiment.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to heat sinks. In particular, the application is directed to a modular heat sink for removing heat from electronic components such as LED components. Although the description of exemplary embodiments is provided below in conjunction with LEDs, alternate embodiments of the invention may be applicable to other types of electronic components needing heat removal or other types of light sources including, but not limited to, incandescent lamps, fluorescent lamps, high intensity discharge lamps ("HID"), or a combination of lamp types known to persons of ordinary skill in the art.

The invention may be better understood by reading the following description of non-limiting, exemplary embodiments with reference to the attached drawings, wherein like parts of each of the figures are identified by like reference characters, and which are briefly described as follows.

FIG. 1 is a top view of a heat sink section 100 in accordance with an exemplary embodiment. Referring to FIG. 1, the heat sink section 100 includes a base 110, a primary extension 130, a secondary extension 141, a first outer extension 140, a second outer extension 160, and one or more fins 180. Although one exemplary embodiment of a heat sink section 100 is described below, alternative shapes for the heat sink section 100 are possible without departing from the scope and spirit of the exemplary embodiment.

The base 110 is substantially concave curve-shaped when viewed from the center of the heat sink and extends along a length downward to create a curved member. In one exemplary embodiment, the radius of curvature for the base 110 is ⅜ inch. However, in alternate exemplary embodiments, the radius of curvature for the base 110 ranges between about 1/10 inch to about twenty inches. The base 110 includes a female connecting part 112 running along the length of one end of the base 110 and a male connecting part 114 running along the length of the opposing end of the base 110. In one exemplary embodiment, the female connecting part 112 is a sliding rail, and the male connecting part 114 is a protrusion extending from the base 110. In this exemplary embodiment, the female connecting part 112 has a substantially cylindrical aperture extending the length of the base capable of receiving the male connecting part 114. In one exemplary embodiment, the female connecting part 112 and the male connecting part 114 are both positioned along the same or substantially similar radius of curvature as the base 110, however, in alternative embodiments, the male 114 and female 112 connecting parts are not in line with the radius of curvature of the base 110. The male connecting part 114 is configured to couple with, or be slidably received within, the female connecting part 112 of another heat sink section 100. In one exemplary embodiment, the male connecting part 114 has a rounded end capable of being disposed within the substantially cylindrical female connecting part 112. Although one example of male and female connecting parts is provided, alternative connecting parts known to persons of ordinary skill in the art can be used without departing from the scope and spirit of the exemplary embodiment.

Although the exemplary embodiment of FIG. 1 has a base 110 with a radius of curvature, an alternative exemplary embodiment includes the base being substantially straight without departing from the scope and spirit of the exemplary embodiment. According to this alternative exemplary embodiment, one of the connecting parts, either male or female, is positioned linearly in the direction of the base at one end of the base, while the other connecting part is positioned in a direction away from the primary extension 130 at the other end of the base. According to this alternative exemplary embodiment, four heat sink sections are interconnected to one another, thereby forming a square-shaped hollow in the center of the modular heat sink.

The primary extension 130 is a substantially planar member that extends radially outwardly from the base 110 at an orthogonal or substantially orthogonal angle and extends longitudinally along the vertical length of the base 110. The primary extension 130 includes an adjacent end 132 positioned along the length of the base 110 and opposing end 133 distal and opposite of the adjacent end 132. In one exemplary embodiment, the primary extension is integrally coupled to and integrally formed with the base 110.

A secondary extension 141 is coupled to the primary extension 130 at an orthogonal or substantially orthogonal angle along the opposing end 133. The secondary extension 141 is a substantially planar member that extends orthogonally from the planar primary extension 130 in two directions and extends vertically along the length of the primary extension 130. The secondary extension 141 includes a first distal end 134, and a second distal end 136. In one exemplary embodiment, the secondary extension 141 is integrally coupled to and integrally formed with the primary extension 130. Furthermore, in this exemplary embodiment, the secondary extension 141 is integrally formed with the base 110. Although this exemplary embodiment has a T-shaped beam combination primary extension 130 and secondary extension 141, alternative exemplary embodiments can have the combination of the primary extension 130 and secondary extension 141 formed into other shapes without departing from the scope and spirit of the exemplary embodiment. For example, in an alternative exemplary embodiment, the secondary extension 141 is concave-shaped or convex-shaped depending upon the desired illumination. In another alternative exemplary embodiment, the primary extension 130 is V-shaped without departing from the scope and spirit of the exemplary embodiment. Further, while one exemplary embodiment teaches the primary extension 130 being integrally coupled to the base 110, alternatively, the primary extension 130 is removably coupled to substantially the middle portion of the base 110 without departing from the scope and spirit of the exemplary embodiment. In yet another alternative embodiment, the primary extension is either integrally or removably coupled to the base adjacent to the male 114 or female 112 connecting part.

The first outer extension 140 is a substantially planar member that extends from the first distal end 134 of the secondary extension 141 at an obtuse angle to the outer surface 233 (FIG. 2) of the secondary extension 141. The first outer extension 140 includes a first end 142 disposed along the first distal end 134 and a second end 144 opposite the first end 142. In one exemplary embodiment, the first end 142 of the first outer extension 140 is integrally coupled to the first distal end 134 of the secondary extension 141. Although the first end 142 of the first outer extension 140 is disclosed as being integrally coupled in FIG. 1 to the first distal end 134 of the secondary extension 141, in an alternative exemplary embodiment, the first outer extension 140 is removably coupled to the first distal end 134 without departing from the scope and spirit of the exemplary embodiment. In one exemplary embodiment, the first outer extension 140 forms an angle of about 120 degrees with the outer surface 233 (FIG. 2) of the secondary extension 141. Although this exemplary embodiment utilizes about a 120 degree angle between the first outer extension 140 and the outer surface 233 (FIG. 2) of the secondary extension 141, alternate angles ranging from about ninety degrees to about 180 degrees can be used. The first outer extension 140 extends radially outward and away from the base 110 to increase the amount of potential surface area for the overall heat sink section 100 and further enhance heat distribution that is generated from one or more LEDs 410 (FIG. 4) coupled to the heat sink section 100. The heat is distributed to the surrounding atmosphere by convection of air through the heat sink section 100 so that the heat is not trapped along the secondary extension 141. Additionally, although the first outer extension 140 of FIG. 1 is substantially planar, alternate exemplary embodiments can have different shapes for the first outer extension 140 including, but not limited to, convex-shaped, concave-shaped, zig-zag-shaped, curvilinear, or a combination of different shapes.

A first male connector 146 extends angularly from the second end 144 of the first outer extension 140. In one exemplary embodiment, the first male connector 146 is a substantially C-shaped member that extends longitudinally along the length of the first outer extension 140. In this exemplary embodiment, the first male connector 146 is integrally coupled to the second end 144 of the first outer extension 140; however, the first male connector 146 can be removably coupled to the second end 144 of the first outer extension 140 without departing from the scope and spirit of the exemplary embodiment. According to this exemplary embodiment, the first male connector 146 includes a substantially planar member extending between the first male connector 146 and second end 144. In an alternative embodiment, the first male connector 146 is positioned immediately adjacent the second end 144. In yet another alternative embodiment, the first female connector 146 extends further from the second end 144 of the first outer extension 140, as shown and described with respect to FIG. 7, thereby providing a different profile shape to the modular heat sink 200 (FIG. 2) once the several heat sink sections 100 are interconnected to each other. Although a first male connector 146 extends from the second end 144, other connectors described above or known to persons of ordinary skill in the art can be used without departing from the scope and spirit of the exemplary embodiment.

The second outer extension 160 is a substantially planar member that extends from the second distal end 136 of the secondary extension 141 at an obtuse angle to the outer surface 233 (FIG. 2) of the secondary extension 141. The second outer extension 160 includes a first end 162 disposed along the second distal end 136 and a second end 164 opposite the first end 162. In one exemplary embodiment, the first end 162 of the second outer extension 160 is integrally coupled to the second distal end 136 of the secondary extension 141. Although the first end 162 of the second outer extension 160 is disclosed as being integrally coupled in FIG. 1 to the second distal end 136 of the secondary extension 141, in an alternative exemplary embodiment, the second outer extension 160 is removably coupled to the second distal end 136 without departing from the scope and spirit of the exemplary embodiment.

In one exemplary embodiment, the second outer extension 160 forms an angle of about 120 degrees with the outer surface 233 (FIG. 2) of the secondary extension 141. Although this exemplary embodiment utilizes about a 120 degree angle between the second outer extension 160 and the outer surface 233 (FIG. 2) of the secondary extension 141, alternate angles ranging from about ninety degrees to about 180 degrees can be used. The second outer extension 160 extends radially outward and away from the base 110 to increase the amount of potential surface area for the overall heat sink section 100 and further enhance heat distribution that is generated from one or more LEDs 410 (FIG. 4) coupled to the heat sink section 100. The heat is distributed to the surrounding atmosphere by convection of air through the heat sink section 100 so that the heat is not trapped along the secondary extension 141. Additionally, although the second outer extension 160 of FIG. 1 is substantially linear, alternate exemplary embodiments include a second outer extension 160 having different shapes, including, but not limited to, convex-shaped, concave-shaped, zig-zag-shaped, curvilinear, or a combination of different shapes.

A second female connector 166 extends angularly from the second end 164 of the second outer extension 160. In one exemplary embodiment, the second female connector 166 is a substantially C-shaped member that extends longitudinally along the length of the second outer extension 160. In this exemplary embodiment, the second female connector 166 is integrally coupled to the second end 164 of the second outer extension 160; however, the second female connector 166 can be removably coupled to the second end 164 of the second outer extension 160 without departing from the scope and spirit of the exemplary embodiment. The second female connector 166 is configured to be slightly larger than the first male connector 146, such that the first male connector 146 slidably couples within the second female connector 166. However, the location of the first male connector 146 and the second female connector 166 may be switched so that the second female connector 166 extends from the first outer extension 140 and the first male connector 146 extends from the second outer extension 160. According to this exemplary embodiment, the second female connector 166 includes a substantially planar member extending between the second female connector 166 and the second end 164 of the second outer extension 160. In an alternative embodiment, the second female connector 166 is positioned immediately adjacent the second end 164. In yet another alternative embodiment, the second female connector 166 extends further from the second end 164 of the second outer extension 160, as shown and described with respect to FIG. 7, thereby providing a different profile shape to the modular heat sink 200 (FIG. 2) once the several heat sink sections 100 are interconnected to each other. Although a second female connector 166 extends from the second end 164, other connectors described above or known to persons of ordinary skill in the art can be used without departing from the scope and spirit of the exemplary embodiment.

One or more fins 180 are configured to extend from at least one of the primary extension 130, the secondary extension 141, the first outer extension 140, and the second outer extension 160. In one exemplary embodiment, each fin 180 is a substantially planar member that extends radially inward at an angle towards the radius of curvature of the base 110 and extends longitudinally along the length of the member from which the fin 180 extends. In certain alternative embodiments, one or more of the fins 180 extends a distance longitudinally that is greater than or equal to the longitudinal distance of the member to which the particular fin 180 is coupled. According to this exemplary embodiment, the fins 180 extend substantially linearly and parallel to each other; however, in alternate embodiments, the fins 180 can be configured to be non-linear and/or non-parallel to each other.

The fins 180 extending on one side of the primary extension 130 are symmetrical or substantially symmetrical to the fins 180 extending on the opposing side of the primary extension 130 and forms a substantially inverted V-shape; however, other shapes may be formed. Further, in one exemplary embodiment, each fin 180 extending on one side of the primary extension 130 has a corresponding fin 180 extending on the opposing side of the primary extension 130 at the same respective radial distance along the primary extension 130. Also, in this exemplary embodiment, each fin 180 extending on one side of the primary extension 130 has the same radial length as its respective corresponding fin 180 extending on the opposing side of the primary extension 130. Further, in this exemplary embodiment, each fin 180 extending on one side of the primary extension 130 has the same longitudinal length as its respective corresponding fin 180 extending on the opposing side of the primary extension 130. However, alternate exemplary embodiments have at least one fin 180 on one side of the primary extension 130 being a different radial length than its corresponding fin 180 on the opposing side of the primary extension 130 or one fin 180 on one side of the primary extension 130 having a different longitudinal length than its corresponding fin 180 on the opposing side of the primary extension 130. For example, in an alternative embodiment, the fin 180 extending on one side of the primary extension 130 has a shorter radial or longitudinal length than its respective corresponding fin 180.

According to the exemplary embodiment of FIG. 1, there are five positions 182 on the primary extension 130 from which a fin 180 extends. For each position 182, there are two fins 180, one extending on each planar side of the primary extension 130. Although five positions 182 are shown on the primary extension 130, there can be greater or fewer positions 182 on the primary extension 130. Additionally, although one fin 180 extends from each planar side of the primary extension 130 at each position 182, there can be greater or fewer fins 180 extending from each position 182, either on one planar side of the primary extension 130 or on both planar sides of the primary extension 130, without departing from the scope and spirit of the exemplary embodiment.

The fins 180 also extend on one side of the first outer extension 140 and one side of the second outer extension 160. The first outer extension 140 has one or more positions 182 that corresponds to the number and location of the positions 182 on the second outer extension 160. In one exemplary embodiment, the fins 180 extending on one side of the first outer extension 140 are symmetrical or substantially symmetrical to the fins 180 extending on one side of the second outer extension 160. In this exemplary embodiment, each fin 180 extending from the first outer extension 140 has a corresponding fin 180 extending from the second outer extension 160. Further, in this exemplary embodiment, each fin 180 extending from the first outer extension 140 has the same radial length and longitudinal length as its respective corresponding fin 180 extending from the second outer extension 160. However, alternate exemplary embodiments can have at least one fin 180 extending from the first outer extension 140 being a different radial and/or longitudinal length than its corresponding fin 180 extending from the second outer extension 160. For example, the fin 180 extending from the first outer extension 140 can have a shorter radial length than its respective corresponding fin 180 extending from the second outer extension 160.

According to the exemplary embodiment of FIG. 1, the primary extension 130, the secondary extension 141, the first outer extension 140, and the second outer extension 160 collectively form a substantially Y-shaped configuration. However, in alternate exemplary embodiments, the primary extension 130, the secondary extension 141, the first outer extension 140, and the second outer extension 160 collectively form various other shapes without departing from the scope and spirit of the exemplary embodiment. Similarly, the outer profile of the heat sink section 100, which is made up of the secondary extension 141, the first outer extension 140 and the second outer extension 160 forms a substantially V-shaped configuration. According to this embodiment, the angle formed in the V-shaped configuration is about sixty degrees. However, in alternate exemplary embodiments, the angle formed in the V-shaped configuration can range from greater than zero degrees to about 180 degrees without departing from the scope and spirit of the exemplary embodiment. Additionally, in another alternative embodiment, the outer profile of the heat sink section 100 forms a substantially V-shaped configuration where the side profile is linear or non-linear without departing from the scope and spirit of the exemplary embodiment.

Figure 2:
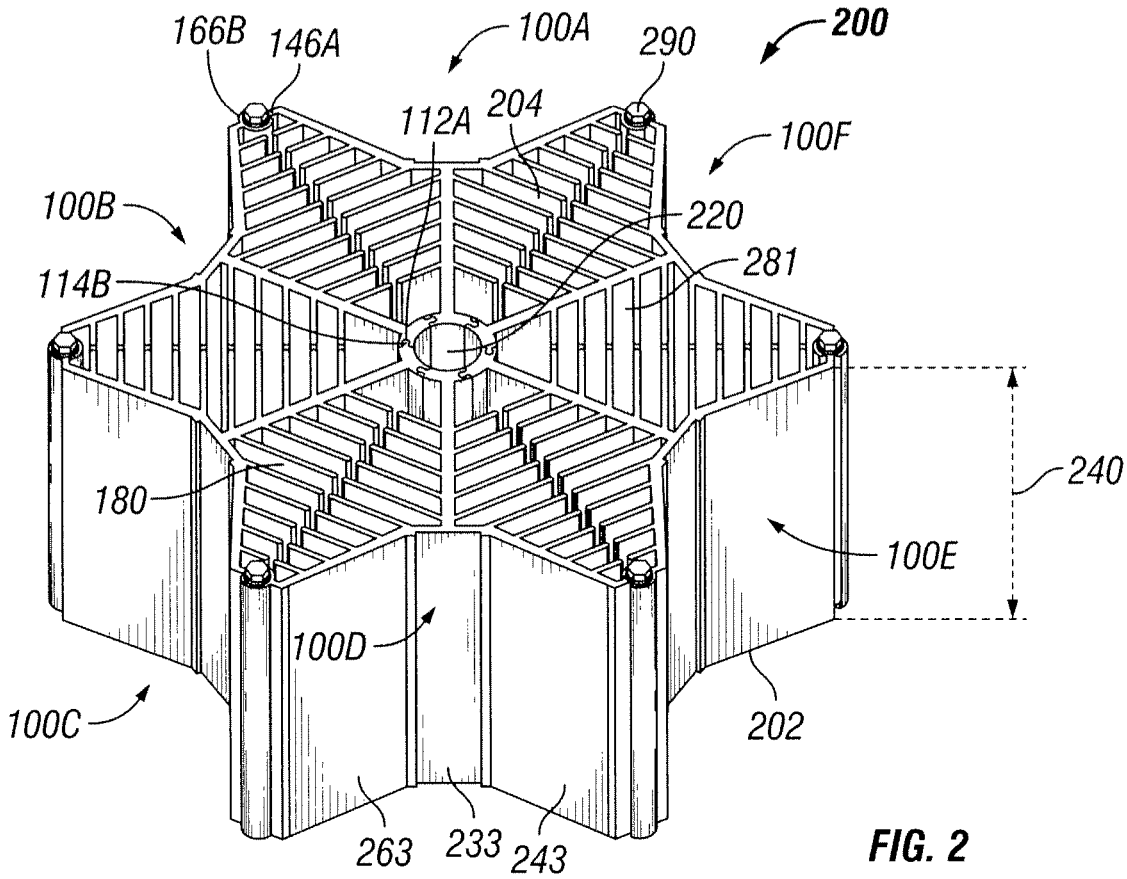
FIG. 2 is a perspective view of a modular heat sink including several interconnected heat sink sections of FIG. 1 in accordance with an exemplary embodiment.
Figure 3:
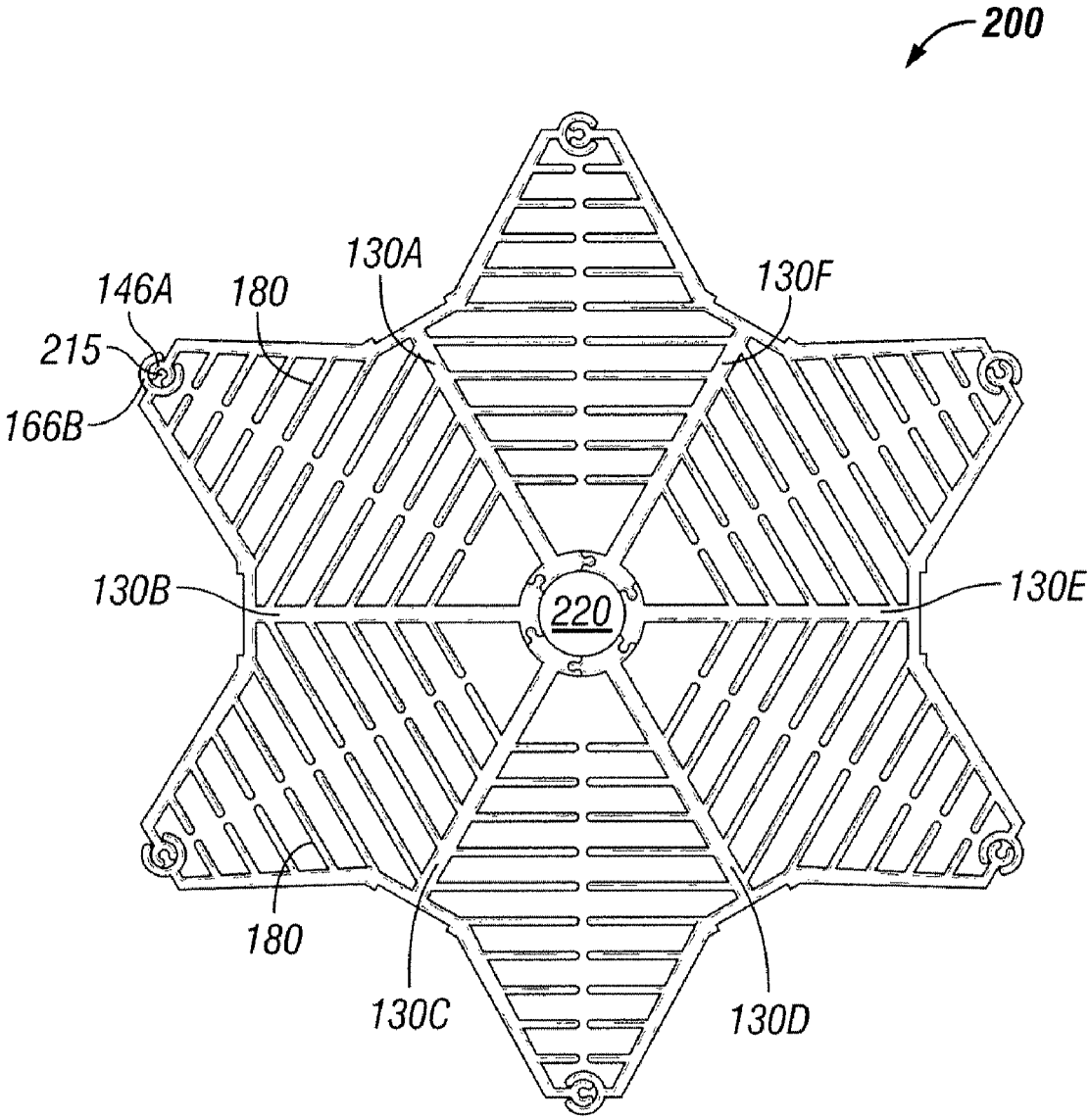
FIG. 3 is a top view of the modular heat sink of FIG. 2 in accordance with an exemplary embodiment.

FIG. 2 is a perspective view of a modular heat sink 200 including several interconnected heat sink sections 100A, 100B, 100C, 100D, 100E, and 100F of FIG. 1 in accordance with an exemplary embodiment. FIG. 3 is a top view of the modular heat sink 200 of FIG. 2 in accordance with an exemplary embodiment. Referring to FIGS. 1, 2 and 3, six heat sink sections 100A, 100B, 100C, 100D, 100E, and 100F are assembled together to form the modular heat sink 200.

The base 110 of the heat sink section 100 includes the female connecting part 112 and the male connecting part 114 for coupling with the female connecting part 112 of another heat sink section. Additionally, the first outer extension 140 of the heat sink section 100 includes the first male connector 146 and the second outer extension 160 of the heat sink section 100 includes the second female connector 166 for coupling with the first male connector 146 of another heat sink section.

Two heat sink sections 100A, 100B are provided adjacent one another where the female connecting part 112A of the first heat sink section 100A is adjacent the male connecting part 114B of the second heat sink section 100B. Similarly, the first male connector 146A of the first heat sink section 100A is adjacent the second female connector 166B of the second heat sink section 100B. As previously described, the male connecting part 114 is configured to be coupled within the female connecting part 112 and the first male connector 146 is configured to be coupled within the second female connector 166.

The male connecting part 114B of the second heat sink section 100B is inserted from the edge of the female connecting part 112A of the first heat sink section 100A. Similarly, the first male connector 146A of the first heat sink section 100A is inserted from the edge of the second female connector 166B of the second heat sink section 100B. This positioning allows the second heat sink section 100B to move relative to the first heat sink section 100A. Once the first heat sink section 100A is aligned accordingly with the second heat sink section 100B, the male connecting part 114B slides within the female connecting part 112A and the second female connector 166B slides exteriorly around the first male connector 146A. The assembler slides the second heat sink section 100B with respect to the first heat sink section 100A until the top surface and the bottom surface of the base 110 are aligned.

Once the second heat sink section 100B is properly positioned with respect to the first heat sink section 100A, the first heat sink section 100A is fastened to the second heat sink section 100B. According to this exemplary embodiment, the first heat sink section 100A is fastened to the second heat sink section 100B using a screw 290 and a bolt (not shown), where the screw 290 proceeds through a passageway 215 formed between the first male connector 146A and the second female connector 166B. In one exemplary embodiment, the perimeter of the head of the screw 290 is equal to or greater than the perimeter of the second female connector 166B. In alternate exemplary embodiments, other fastening means are used without departing from the scope and spirit of the exemplary embodiment. For example, in one alternative embodiment, the first male connector 146A is configured to be jammed within the larger second female connector 166B so that the first heat sink section 100A is no longer slidable with respect to the second heat sink section 100B. In another alternative embodiment, one of the first male connector 146A or the second female connector 166B is threaded at its longitudinal ends so that a nut (not shown) can be screwed thereon to ensure that the first heat sink section 100A is securely coupled to the second heat sink section 100B.

The remaining heat sink sections 100C, 100D, 100E, and 100F are similarly assembled in a polar array with the previous heat sink sections 100A, 100B to form the modular heat sink 200. Once the modular heat sink 200 is formed, a channel or hollow 220 is formed substantially at the center of the modular heat sink 200. Using conventional forming methods, this channel 220 is not directly formable when manufacturing heat sinks using the extrusion process. Thus, the combined heat sink sections 100A, 100B, 100C, 100D, 100E, and 100F form the modular heat sink 200, which could itself not be extruded by itself. Hence, this and other exemplary embodiments allow complex heat sinks to be directly formed which would normally not be possible when using a cost effective extrusion process.

In the exemplary embodiment of FIGS. 2 and 3, the profile of the modular heat sink 200 is star-shaped. The points on the star are where adjacent heat sink sections 100 interlock and provide for a surface area to extend beyond the thermal perimeter of the modular heat sink 200 and into much cooler air. However, alternate exemplary embodiments have profiles with other geometric shapes, including, but not limited to, square, circular, star-shaped with a different number of points on the star, and star-shaped with flat sides instead of points. Also, in the exemplary embodiment of FIGS. 2 and 3, once the modular heat sink 200 is assembled, the fins 180 extending from the primary extension 130A, 130B, 130C, 130D, 130E, and 130F form substantially concentric hexagonal shapes. However, alternate exemplary embodiments can have fins 180 forming other geometric shapes depending upon the number of heat sink sections 100 that are used to form the modular heat sink 200 and the angular disposition of those fins 180 along each primary extensions 130A, 130B, 130C, 130D, 130E, and 130F. The fins 180 form air channels 281 between the concentric hexagonal shapes that create a venturi effect, drawing air through the air channels 281. The air travels from the bottom end 202 of the modular heat sink 200, through the air channels 281, and out the top end 204 of the modular heat sink 200. This air movement assists in dissipating heat generated by one or more LEDs 410 (FIG. 4) coupled to the modular heat sink 200 along the outer surface 233 of the secondary extension 141.

This exemplary embodiment illustrates the modular heat sink 200 having six heat sink sections 100A, 100B, 100C, 100D, 100E, and 100F. However, alternate exemplary embodiments can have the number of heat sink sections 100 range from two to twenty and still form a channel 220 substantially at the center of the modular heat sink 200 without departing from the scope and spirit of the exemplary embodiment.

In one exemplary embodiment, the modular heat sink 200 has a longitudinal length 240 of about four inches. However, in alternate exemplary embodiments, the longitudinal length 240 ranges from about one inch to about ten feet. As the longitudinal length 240 of the modular heat sink 200 increases, more heat is capable of being collected from the LEDs 410 (FIG. 4) and distributed to the surrounding environment through the fins 180. Hence, more LEDs 410 (FIG. 4) can be coupled to the modular heat sink 200 or LEDs 410 (FIG. 4) emitting light having a greater intensity (as measured in watts) can be coupled to the modular heat sink 200. Similarly, in alternative embodiments the diameter of the modular heat sink 200 is variable based on the desired end-use. As the diameter of the modular heat sink 200 increases, the modular heat sink's 200 ability to dissipate heat also increases. Hence, a greater lumen output is achievable from a lamp using the modular heat sink 200.

In one exemplary embodiment, the outer surface 243 of the first outer extension 140 and the outer surface 263 of the second outer extension 160 of each heat sink section 100 are reflective. In another exemplary embodiment, the outer surface 243 of the first outer extension 140, the outer surface 263 of the second outer extension 160, and the outer surface 233 of the secondary extension 130 are reflective. Although polishing is one method available for making the outer surfaces 243, 263, and 233 reflective, other methods known to persons of ordinary skill in the art can be used without departing from the scope and spirit of the exemplary embodiment. For example, the outer surfaces 243, 263, and 233 can be metallized or a thin metallic surface can be applied over the outer surfaces to make them reflective.

In one exemplary embodiment, the materials used to manufacture the base 110, the primary extension 130, the secondary extension 141, the first outer extension 140, the second outer extension 160, and the fins 180 of each heat sink section 100 include any suitable material capable of being extruded, including, but not limited to, metals, such as aluminum, copper, lead, tin, magnesium, zinc, steel, and titanium, metal alloys, polymers, and ceramics. In one exemplary embodiment, the components for each heat sink section 100 are manufactured as an integral unit and directly through the extrusion process; however, according to alternative embodiments, the components of each heat sink section 100 are manufactured separately and coupled to one another using the above described fastening means or any other fastening means known to persons of ordinary skill in the art, including, but not limited to, welding.

Figure 4:
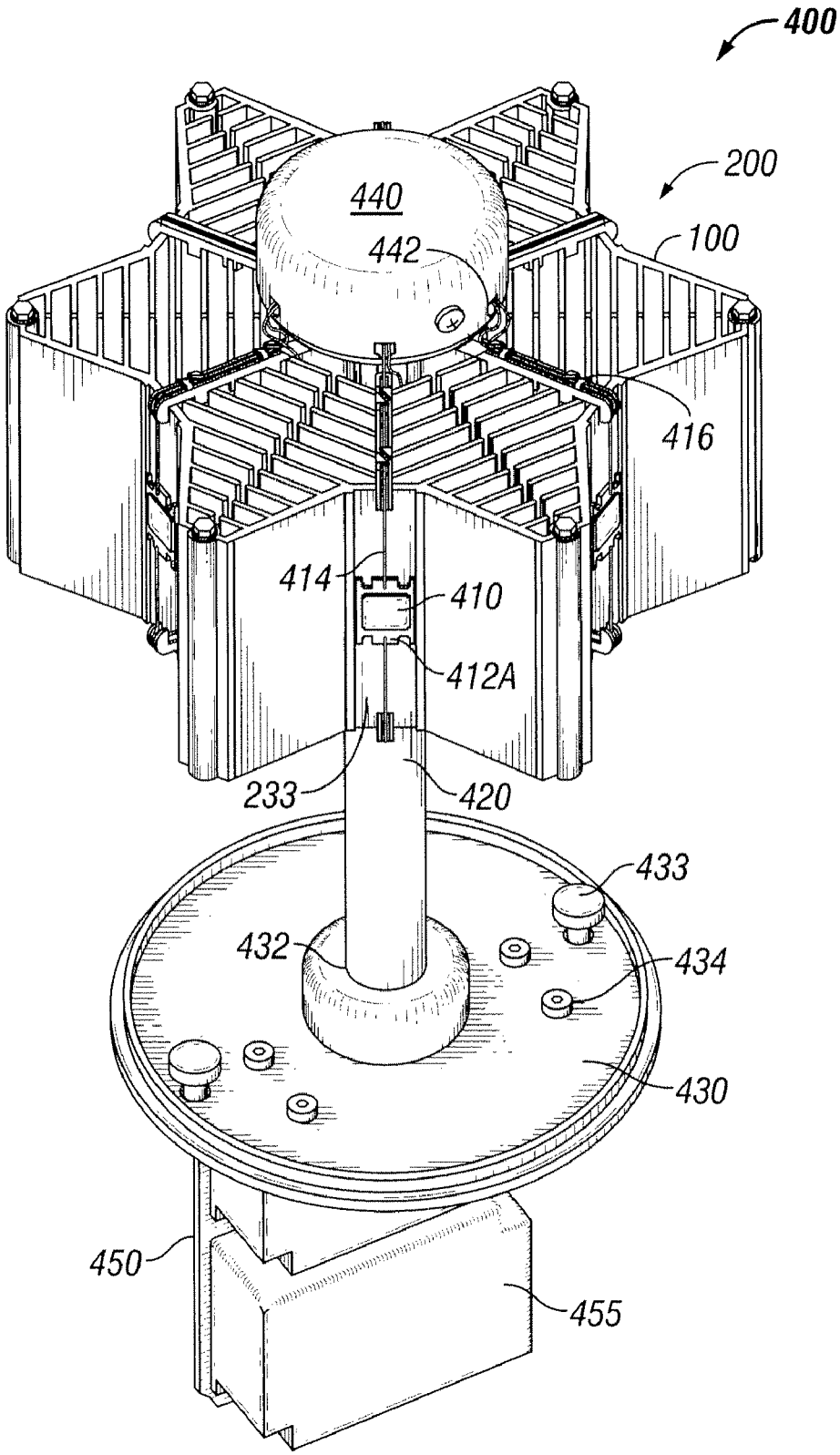
FIG. 4 is a perspective view of an LED mounting structure utilizing the modular heat sink of FIG. 2 in accordance with an exemplary embodiment.
Figure 5:
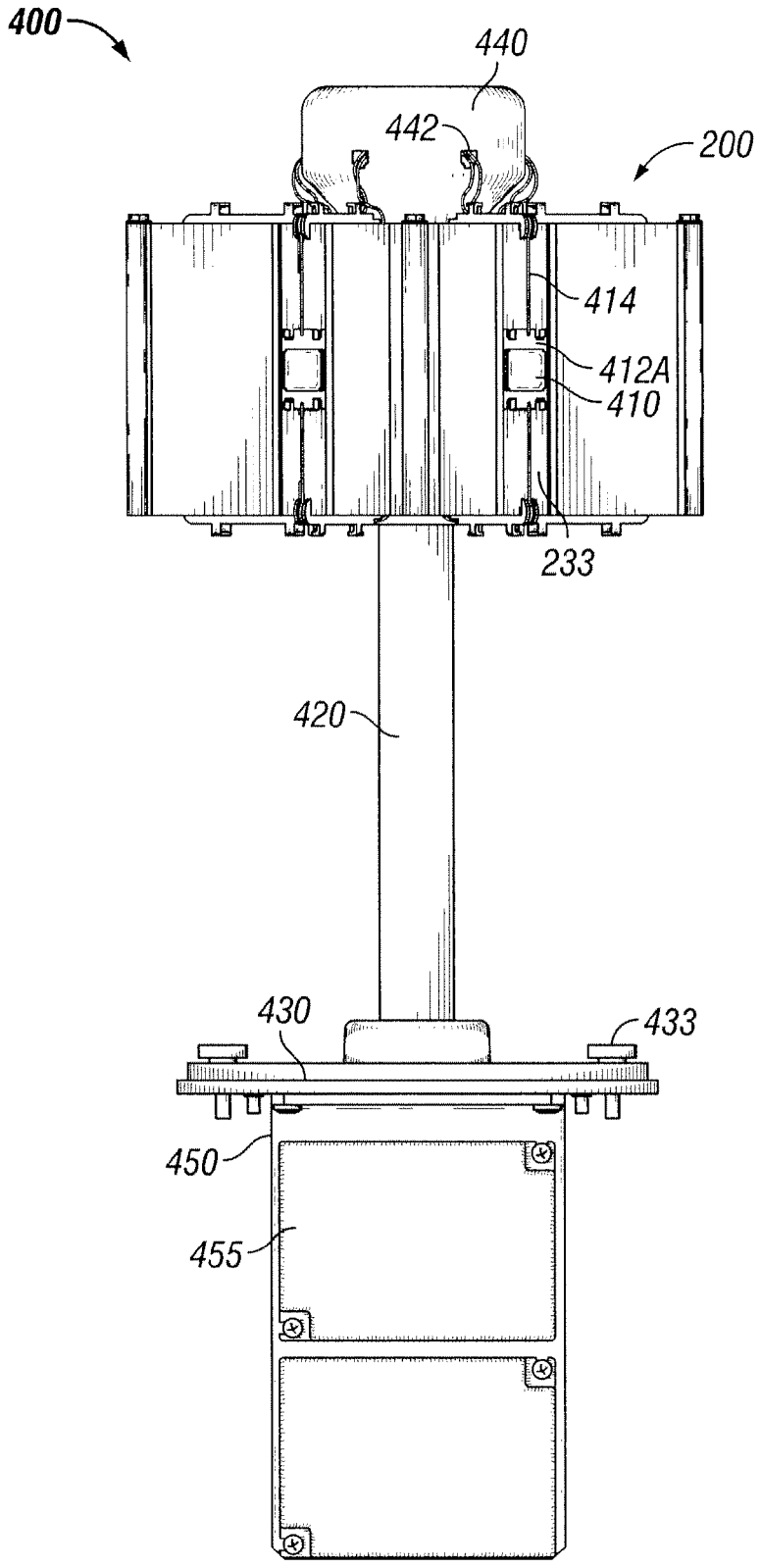
FIG. 5 is an elevational view of the LED mounting structure of FIG. 4 in accordance with an exemplary embodiment.

FIG. 4 is a perspective view of an LED mounting structure 400 utilizing the modular heat sink 200 of FIG. 2 in accordance with an exemplary embodiment. FIG. 5 is an elevational view of the LED mounting structure 400 of FIG. 4 in accordance with an exemplary embodiment. Now referring to FIGS. 1, 2, 4, and 5, the LED mounting structure 400 includes the modular heat sink 200, one or more LEDs 410, electrical wiring 414, a wire-way tube 420, and a mounting plate 430. In some exemplary embodiments, the LED mounting structure 400 also includes wire management clips 416. In alternate exemplary embodiments, the LED mounting structure 400 further includes a junction box (not shown) and a junction cap 440. In still other alternate embodiments, the LED mounting structure 400 further includes a driver mounting bracket 450 and one or more LED drivers 455.

The modular heat sink 200 includes several heat sink sections 100 interlocked with one another and its features and some of its potential modifications have been described above in detail. The modular heat sink 200 is configured to disperse the maximum amount of heat created by one or more LEDs 410 coupled thereon. In one exemplary embodiment, one or more LEDs or one or more LED packages, each package including one or more LED die, is disposed on the outer surface 233 of the secondary extension 141 of one or more of the heat sink sections 100. For purposes of this discussion, the use of the term LED includes both individual LEDs and LED packages that include and LED array that includes a chip on board and one or multiple LED dies on each package. In certain exemplary embodiments, the number of LEDs capable of being disposed on an LED package ranges from 1-312, however, greater numbers of LEDs are capable of being disposed on an individual package based on the particular application of the luminaire using the LED mounting structure 400.

Each LED 410 is coupled to the outer surface 233 of the secondary extension 141. The LEDs 410 are oriented such that each emits light in a direction that is substantially perpendicular to the axis of the channel 220. Although not illustrated in this exemplary embodiment, the LEDs can also be coupled to one or both of the outer surfaces 243, 263. For simplicity, each outer surface 233 of the secondary extension 141 is referred to as a "facet." The LEDs 410 are mounted to the facets 233 using thermal tape (not shown). The thermal tape accomplishes a two-fold purpose of both adhering the LEDs 410 to the facet 233 and assisting in the transmission of heat from the LEDs 410 to the facet 233. In alternative embodiments, the LEDs 410 are mounted to the facet 233 using solder, braze, welds, glue, plug-and-socket connections, epoxy, rivets, clamps, fasteners, or other means known to persons of ordinary skill in the art having the benefit of the present disclosure.

In the exemplary embodiment of FIGS. 4 and 5, the modular heat sink 200 includes six longitudinally extending facets 233. The number of facets 233 can vary depending on the size of the LEDs 410, the diameter and shape of the modular heat sink 200, the number of heat sink sections 100, cost considerations, and other financial, operational, and/or environmental factors known to persons of ordinary skill in the art having the benefit of the present disclosure. Each facet 233 is configured to receive one or more LEDs 410 in one or more positions longitudinally along the length of the facet 410. The greater the number of facets 233 or the longer the facet 233, the greater the number of LED 410 positions available, and thus more optical distributions become available.

In one exemplary embodiment, each facet 233 is configured to receive one or more columns of LEDs 410 extending longitudinally along the length of the facet 233, in which each column includes one or more LEDs 410. The term "column" is used herein to refer to an arrangement or a configuration whereby one or more LEDs 410 are disposed approximately in or along a line. LEDs 410 in a column are not necessarily in perfect alignment with one another. For example, one or more LEDs 410 in a column might be slightly out of alignment due to manufacturing tolerances or assembly deviations. In addition, LEDs 410 in a column can be purposefully staggered in a non-linear arrangement. Each column extends along a longitudinal axis of its associated facet 233.

In certain exemplary embodiments, each LED 410 is mounted to its corresponding facet 233 using a substrate 412A. In one exemplary embodiment, the substrate 412A is a printed circuit board or a metal core printed circuit board. Each substrate 412A includes one or more sheets of ceramic, metal, laminate, or another material. Each LED 410 is attached to its respective substrate 412A using a solder joint, a plug, epoxy, a bonding line, or another suitable provision for mounting an electrical/optical device on a surface. Each substrate 412A is connected to electrical wiring 414 for supplying electrical power to the associated LEDs 410 on that substrate 412A.

In certain exemplary embodiments, the LEDs 410 include semiconductor diodes configured to emit incoherent light when electrically biased in a forward direction of a p-n junction. For example, each LED 410 can emit blue or ultraviolet light. The emitted light can excite a phosphor that in turn emits red-shifted light. The LEDs 410 and the phosphors can collectively emit blue and red-shifted light that essentially matches black-body radiation. The emitted light approximates or emulates incandescent light to a human observer. In certain exemplary embodiments, the LEDs 410 and their associated phosphors emit substantially white light that may seem slightly blue, green, red, yellow, orange, or some other color or tint. Exemplary embodiments of the LEDs 410 include indium gallium nitride ("InGaN") or gallium nitride ("GaN") for emitting blue light; however, other color lights can be emitted using alternate types of LEDs.

In certain exemplary embodiments, one or more of the LEDs 410 include multiple LED elements mounted together on a single substrate 412A, also referred to as a package. Each of the LED elements, or groups therein, can produce the same or a distinct color of light. In one exemplary embodiment, the LED elements collectively produce substantially white light or light emulating a black-body radiator. In certain exemplary embodiments, some of the LEDs 410 produce one color of light while others produce another color of light. Thus, in certain exemplary embodiments, the LEDs 410 provide a spatial gradient of colors.

In certain exemplary embodiments, optically transparent or clear material (not shown) encapsulates each LED 410 and/or LED element, either individually or collectively. This material provides environmental protection while transmitting light. For example, this material can include a conformal coating, a silicone gel, cured/curable polymer, adhesive, or some other material known to persons of ordinary skill in the art having the benefit of the present disclosure. In certain exemplary embodiments, phosphors configured to convert a light of one color to a light of another color are coated onto or dispersed within the encapsulating material.

The wireway tube 420 is a hollow tube. At least a portion of the wireway tube 420 is slidably inserted into the channel 220 and coupled to the channel 220. The hollow portion of the wireway tube 420 provides an area for which the electrical wiring 414 proceeds through it and for at least partially concealing the electrical wiring 414 when electrically coupling the LEDs 410 to a power supply source or one or more drivers 455. The other end of the wireway tube 420 is securely coupled to the mounting plate 430. In one exemplary embodiment, the wireway tube 420 has a cylindrical shape that is similar to the substantially cylindrical shape of the channel 220 and is configured for one end of the wireway tube 420 to be inserted through at least a portion of the channel 220. According to this exemplary embodiment, the wireway tube 420 has a circular cross-section; however, the wireway tube 420 can be fabricated into other geometric shapes without departing from the scope and spirit of the exemplary embodiment. In an alternative embodiment, the wireway tube 420 extends through the entirety of the channel 220 and extends out from each end of the channel 220. The wireway tube 420 is manufactured according to any method known to persons of ordinary skill in the art, including, but not limited to, extruding and machining the hollow therein, casting, and forging. In addition, the wireway tube 420 is fabricated from any suitable material including, but not limited to, aluminum, steel, polymers, and metal alloys.

The mounting plate 430 is a substantially circular plate that includes an opening 432, one or more mounting holes 433, and one or more mounting bracket holes 434 formed therein. In one exemplary embodiment, the opening 432 is positioned at or substantially near the center of the circular mounting plate 430; however, in alternate exemplary embodiments the opening 432 is positioned at any location on the mounting plate 430. According to this exemplary embodiment, the opening 432 has a shape that is the same as or similar to the shape of the channel 220 and is configured to receive the other end of the wireway tube 420. While the exemplary embodiment of FIGS. 4 and 5 teaches the mounting plate 430 having a circular shape; in alternate exemplary embodiments, the mounting plate 430 takes other geometric shapes, including, but not limited to, square, rectangular, triangular, and oval.

Figure 8:
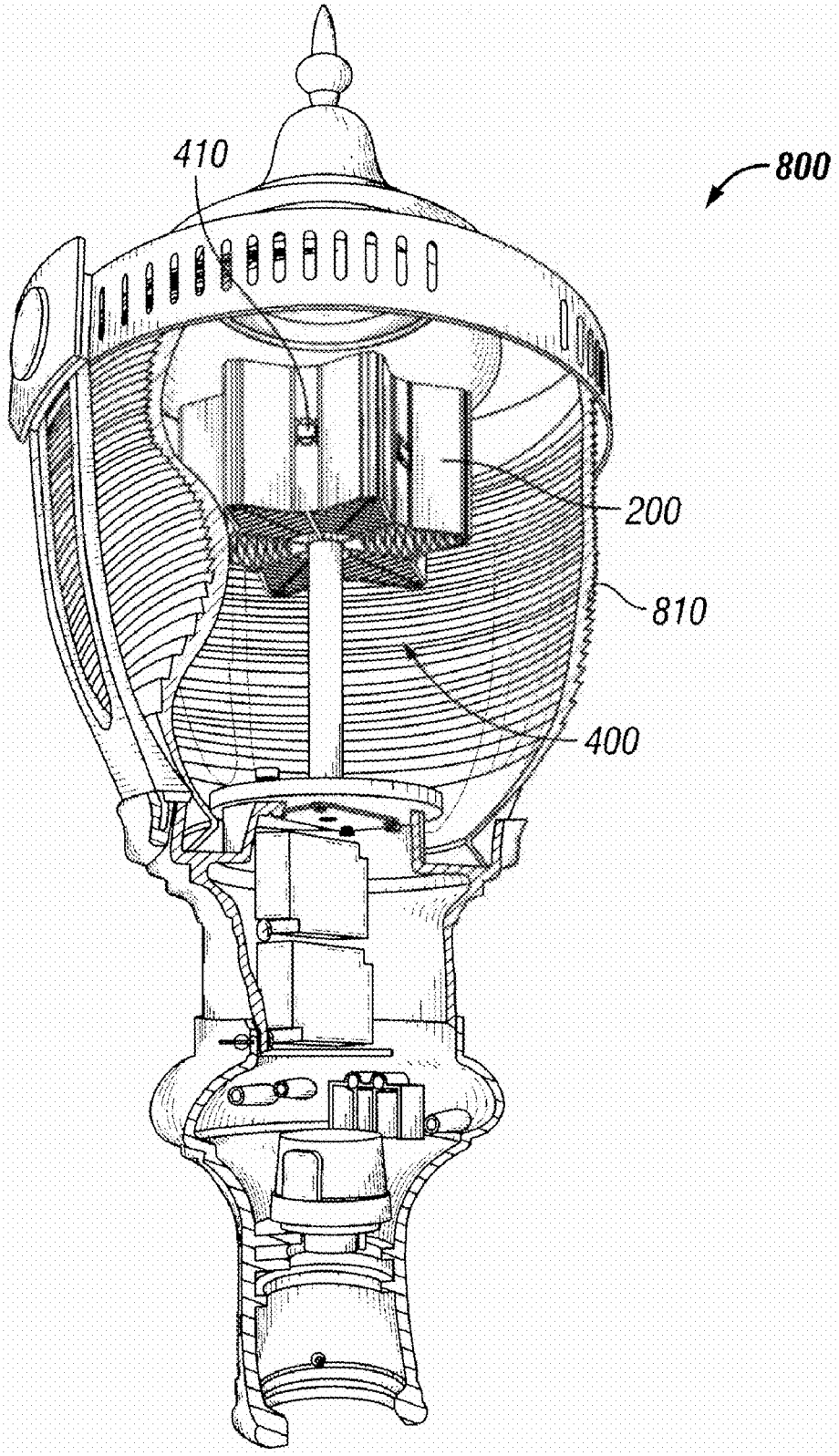
FIG. 8 is a perspective cutaway view of a luminaire utilizing the LED mounting structure of FIG. 4 in accordance with an exemplary embodiment.

The mounting holes 433 formed within the mounting plate 430 are used to mount the mounting plate 430 to a mounting structure, such as a post-top luminaire (not shown), thereby forming a post-top luminaire 800 (FIG. 8). The mounting bracket holes 434 are used to releasably mount the driver mounting bracket 450 to the mounting plate 430 and are capable of receiving fasteners, such as screws, rivets, nails, and other fasteners known to persons of ordinary skill in the art, to releasably couple the driver mounting bracket 450 to the mounting plate 430. In certain exemplary embodiments, the driver mounting bracket 450 is coupled to the mounting plate 430 on an opposing surface from which the wireway tube 420 extends.

In one exemplary embodiment, the driver mounting bracket 450 is substantially rectangular; however, in alternative embodiments, the driver mounting bracket 450 is another geometric shape, including, but not limited to, square, circular, triangular, and oval. The driver mounting bracket 450 provides a surface for which one or more drivers 455 are mounted. In this exemplary embodiment, the driver mounting bracket 450 is fabricated from aluminum; however, according to alternate exemplary embodiments, the driver mounting bracket 450 is fabricated from any other suitable material, including, but not limited to, steel, polymers, and metal alloys. The drivers 455 are mounted to the driver mounting bracket 450 and provide electrical power and control to the LEDs 410 using the electrical wiring 414. In certain alternative embodiments, several drivers 455 are mounted to the driver mounting bracket 450 and each driver 455 provides electrical power to one or more LEDs 410 so that the direction and intensity of light emitted by each LED 410 is individually controlled by one of the drivers 455. In some exemplary embodiments, the drivers 455 are capable of varying the amount of power delivered to the LEDs 410, thereby having the LEDs emit more or less light. Also, in certain exemplary embodiments, the drivers 455 are configured to control the LEDs in such a way that the LEDs 410 turn on and off intermittently, thereby making the LEDs blink.

In addition, fasteners of the type described above releasably couple the mounting plate 430 to the mounting structure. In certain exemplary embodiments, the mounting plate 430 is fabricated from sand cast aluminum; however, according to alternate exemplary embodiments, the mounting plate 430 is fabricated from any suitable material, including, but not limited to, steel, polymers, and metal alloys.

In some exemplary embodiments, wire management clips 416 are coupled along at least a portion of the primary extension 130 and are positioned at the top end 204 and the bottom end 202 of the modular heat sink 200. According to this exemplary embodiment, the wire management clips 416 extend the entire radial length of each of the primary extension 130. The wire management clips 416 provide a pathway for the electrical wiring 414 from the junction cap 440 to the outer surface 233 of the secondary extension 141. The wire management clips 416 maintain the positioning of the electrical wiring 414 and protect the electrical wiring 414 from heat and other types of damage. Although the wire management clips 416 are positioned at the top end 204 and the bottom end 202 of the modular heat sink 200, alternate exemplary embodiments can have the wire management clips 416 positioned at one end of the modular heat sink 200, either the top end 204 or the bottom end 202.

In certain exemplary embodiments, a junction box (not shown) is disposed over the channel 220 at the top end 204 of the modular heat sink 200. The junction box receives the electrical wiring 414 from the channel 220 and provides electrical junctions for distributing the electrical power to the several LEDs 410 using additional electrical wiring 414. The junction box cap 440 is disposed over and rotatably coupled to the junction box to visually conceal the electrical junctions, provide protection to the electrical junctions, and provide one or more pathways 442 for the several electrical wirings 414 extending from the junction box to the LEDs 410. These pathways 442 surround the perimeter of the junction box cap 440. In one exemplary embodiment, the pathways 442 are substantially aligned with the axis of the primary extension 130. Although the pathways 442 are substantially aligned with the axis of each of the primary extensions 130, alternate exemplary embodiments have pathways that are not substantially aligned with the axis of each of the primary extensions 130 without departing from the scope and spirit of the exemplary embodiment. Further, in one exemplary embodiment, the junction box cap 440 is substantially circular; however, in alternative embodiments the junction box cap 440 takes other geometric shapes including, but not limited to, square, rectangular, triangular, and oval. In certain exemplary embodiments, the junction box and the junction box cap 440 are fabricated from spun aluminum; however, in alternate exemplary embodiments, the junction box and the junction box cap 440 are fabricated from any other suitable material, including, but not limited to, steel, polymers, and metal alloys.

Figure 6:
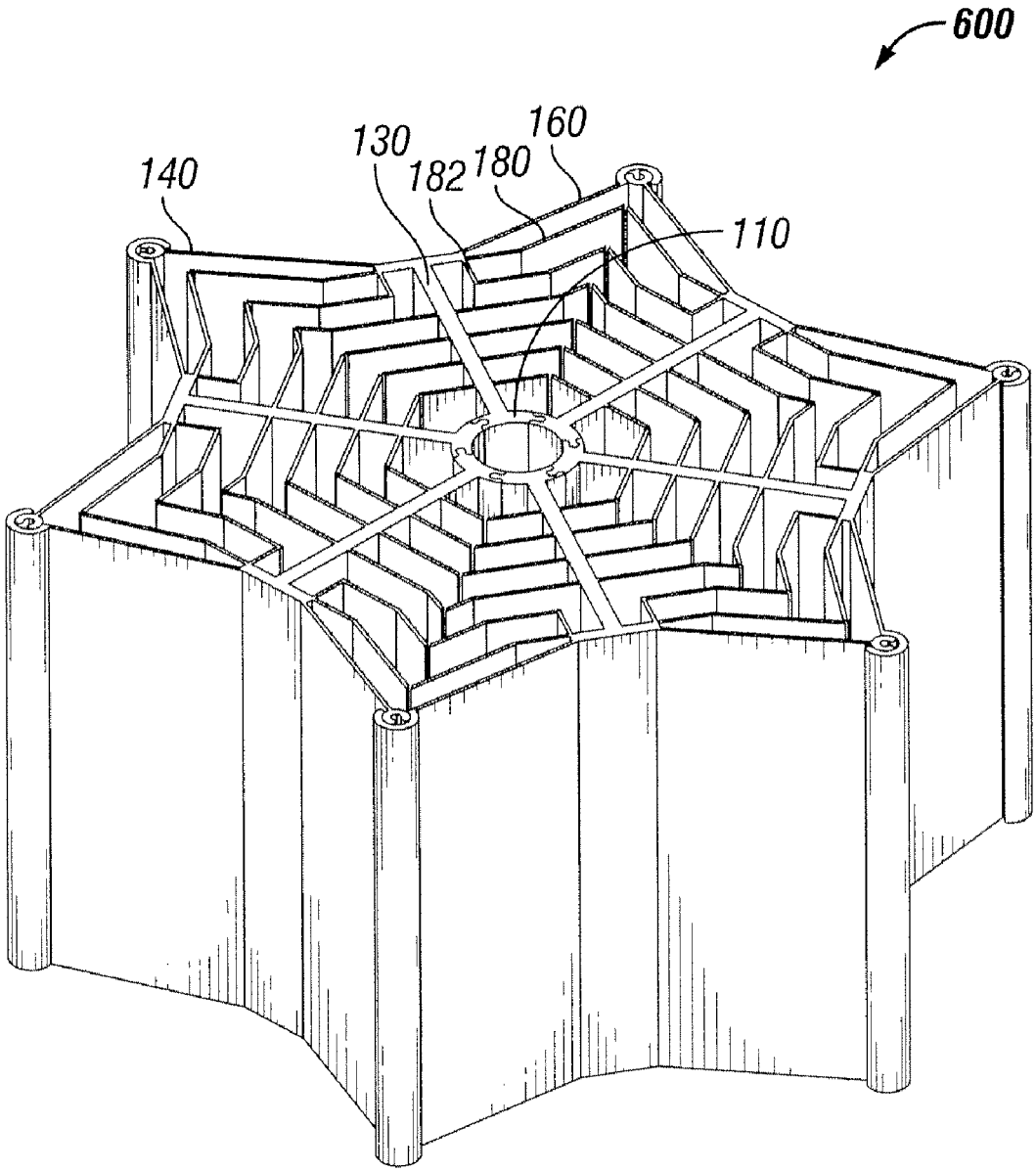
FIG. 6 is a perspective view of an alternative modular heat sink in accordance with another exemplary embodiment.

FIG. 6 is a perspective view of a modular heat sink 600 in accordance with an alternative exemplary embodiment. The modular heat sink 600 is similar to the modular heat sink 200 of FIGS. 1, 2 and 3, except for the configuration of the fins 180. Modular heat sink 600 includes the features and potential modifications that can be implemented to it as described with respect to the modular heat sink 200 of FIGS. 1, 2, and 3.

According to the alternative exemplary embodiment of FIG. 6, the fins 180 extend outwardly from both planar sides of the primary extension 130. At least a portion of that extension of the fins 180 is orthogonal or substantially orthogonal to the radial direction of the primary extension 130. Fins 180 also extend from the secondary extension 141. In addition, fins 180 do not extend from the first outer extension 140 or the second outer extension 160. Some of the fins 180 positioned closer to the first outer extension 140 and the second outer extension 160 extend outwardly from the primary extension 130 and/or secondary extension 141 and angle radially away from the base 110 in a manner that is parallel with either the first outer extension 140 or the second outer extension 160. This configuration results in the fins 180 being configured in a hexagonal shape with outwardly formed conical shaped points at each junction of the hexagonal sides. This configuration provides for additional surface area of the fins 180 to extend beyond the thermal perimeter of the modular heat sink 600 and into cooler air.

The exemplary embodiment of FIG. 6 also depicts two fins 180 extending from a single position 182 on one side of the secondary extension 141. This position 182 is located at both edges of the secondary extension 141.

Although the exemplary embodiment of FIG. 6 teaches there being no fins 180 extending from either the first outer extension 140 or the second outer extension 160, some alternative exemplary embodiments include fins 180 extending from the first outer extension 140 and the second outer extension 160. Also, although some fins 180 extend outwardly from the primary extension 130 and/or the secondary extension 141 and angle radially away from the base 110 in a manner that is parallel with either the first outer extension 140 or the second outer extension 160, all fins 180 can extend outwardly from the primary extension 130 and/or secondary extension 141 and angle away from the base 110 in a manner that is parallel with either the first outer extension 140 or the second outer extension 160. In certain other exemplary embodiments, the fins 180 are disposed in any other configuration that is capable of being directly extruded as part of a heat sink section 100.

Figure 7:
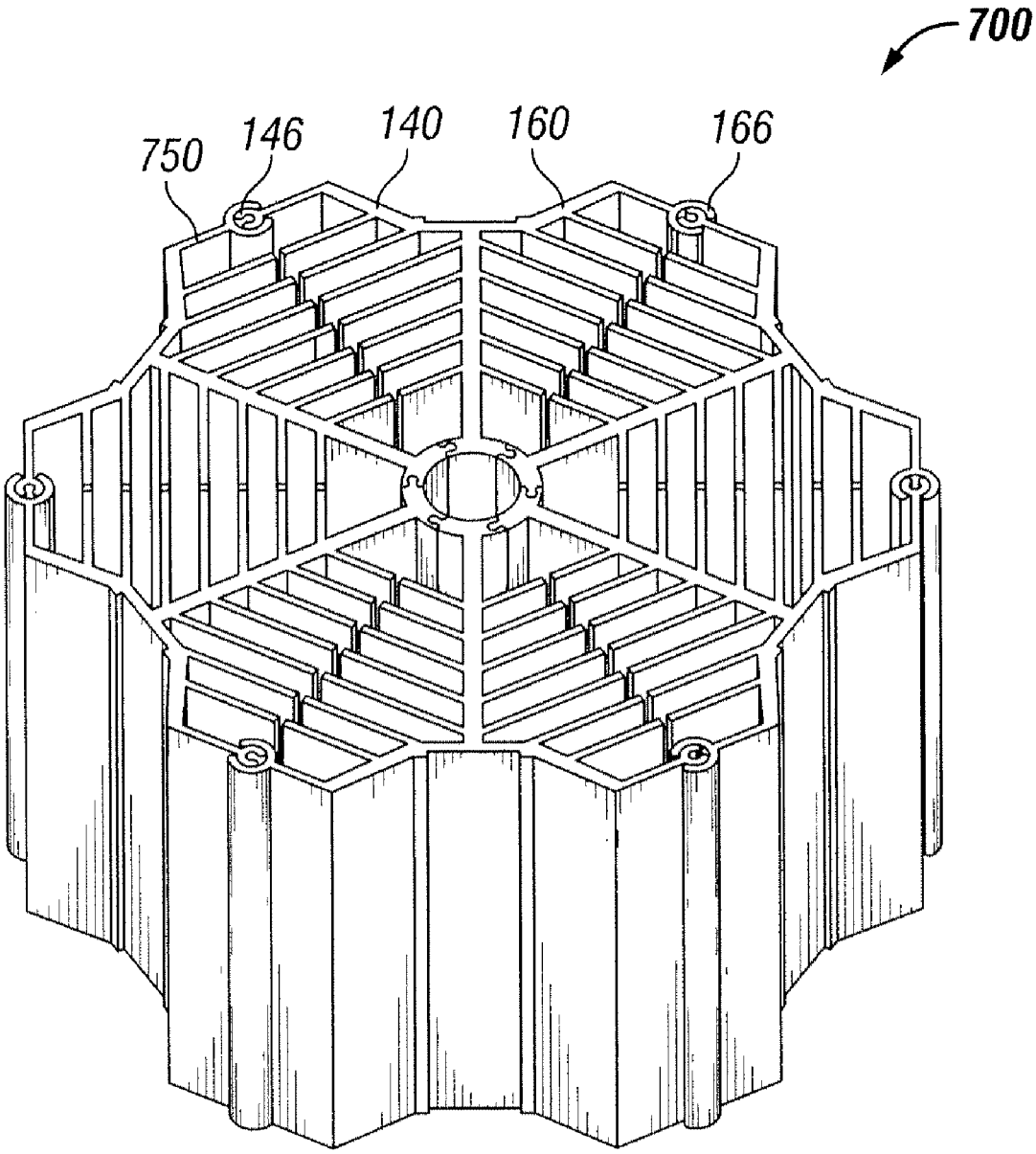
FIG. 7 is a perspective view of another alternative modular heat sink in accordance with yet another exemplary embodiment.

FIG. 7 is a perspective view of a modular heat sink 700 in accordance with yet another alternative exemplary embodiment. The modular heat sink 700 is similar to the modular heat sink 200 of FIGS. 1, 2 and 3, except for the exterior shape of the modular heat sink 700. Modular heat sink 700 includes the features and potential modifications that can be implemented to it as described with respect to the modular heat sink 200 of FIGS. 1, 2, and 3.

Turning now to FIG. 7, the shape of the modular heat sink 700 has been altered by extending the distance between the first male connector 146 and the substantially planar portion of the first outer extension 140 and by extending the distance between the second female connector 166 and the substantially planar portion of the second outer extension 160. This configuration results in the modular heat sink 700 having a star-shaped exterior perimeter with substantially flat sides 750 instead of points. These substantially flat sides 750 provide greater surface area along the perimeter of the modular heat sink 700 and into much cooler air than the star shape with points embodiment.

FIG. 8 is a perspective cutaway view of a post-top luminaire 800 utilizing the LED mounting structure 400 of FIG. 4 in accordance with an exemplary embodiment. Luminaire 800 includes a transparent cover 810 surrounding the LEDs 410 and the modular heat sink 200. Although a transparent cover 810 is shown in this exemplary embodiment, some exemplary embodiments have no transparent cover surrounding the LEDs 410 and the modular heat sink 200. Although one exemplary luminaire 800 is illustrated in FIG. 8, the luminaire can be any shape or size that accommodates the modular heat sink 200.

Although each exemplary embodiment has been described in detail, it is to be construed that any features and modifications that are applicable to one embodiment are also applicable to the other embodiments.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A modular heat sink, comprising:

a plurality of heat sink sections interconnected sequentially to each other to form a polar array, each heat sink section comprising:

a base comprising a first connecting part at one end of the base and a second connecting part at an opposing end of the base;

a primary extension extending radially outward from the base;

a second primary extension coupled at a substantially orthogonal angle to the primary extension, wherein the second primary extension comprises a first distal end and a second distal end opposite the first;

a first outer extension coupled to the first distal end of the secondary extension and extending radially outward from the secondary extension at an angle;

a second outer extension coupled to the second distal end of the secondary extension and extending radially outward from the secondary extension at an angle in an opposite direction than the first outer extension; and a plurality of fins extending from at least one of the primary extension, the secondary extension the first outer extension, and the second outer extension;

wherein the first connecting part of each heat sink section is interconnected with the second connecting part of an adjacent heat sink section.

2. The modular heat sink of claim 1, wherein the first connecting part is a male connecting part and the second connecting part is a female connecting part.

3. The modular heat sink of claim 1, wherein a hollow channel extends longitudinally substantially through the center of the modular heat sink.

4. The modular heat sink of claim 1, wherein the first outer extension comprises a first outer planar surface and the second outer extension comprises a second outer planar surface, each of the first and second outer planar surfaces disposed along an outer perimeter of the modular heat sink and facing radially outward, wherein the first and second outer planar surfaces are reflective.

5. The modular heat sink of claim 1, wherein the secondary extension comprises an inner planar surface and an outer planar surface, wherein the primary extension is coupled to the inner planar surface and wherein the outer planar surface is disposed along an outer perimeter of the modular heat sink and faces radially outward, wherein the heat sink further comprises one or more LEDs positioned on the outer planar surface of the secondary extension for at least one of the heat sink sections.

6. The modular heat sink of claim 1, wherein the angle is between about ninety degrees to about 180 degrees.

7. The modular heat sink of claim 1, wherein the fins create a venturi effect where the air flows from a bottom end of the modular heat sink, through a plurality of passageways formed between the fins, and exits a top end of the modular heat sink.

8. The modular heat sink of claim 1, wherein the first outer extension comprises a first connector and the second outer extension comprises a second connector, wherein the first connector of each heat sink section is coupled with the second connector of an adjacent heat sink section.

9. The modular heat sink of claim 1, wherein at least a portion of an outer perimeter of the modular heat sink is configured to be positioned outside the thermal perimeter of the modular heat sink.

10. An LED luminaire, comprising:

a modular heat sink comprising:

a plurality of heat sink sections interconnected sequentially to each other to form a polar array, each heat sink section having substantially the same shape and comprising:

a base having a radius of curvature and comprising:

a first longitudinal edge;

a second longitudinal edge opposite the first longitudinal edge of the base;

a first connecting part positioned along the first longitudinal edge of the base along the radius of curvature; and a second connecting part positioned along the second longitudinal edge of the base along the radius of curvature;

wherein the first connecting part of each heat sink section is interconnected with the second connecting part of an adjacent heat sink section;

a primary extension extending orthogonally from the base, the primary extension comprising a planar member comprising:

a first planar surface;

a second planar surface;

a first longitudinal edge; and a second longitudinal edge opposite the first longitudinal edge of the planar member;

a secondary extension comprising a planar member having a first longitudinal edge, a second longitudinal edge, an outer planar surface and an inner planar surface, wherein the secondary extension is coupled to the second longitudinal edge of the primary extension and extending orthogonal to the primary extension;

a plurality of fins, each fin comprising a planar member, wherein at least a first portion of the fins extend from the first planar surface of the primary extension and wherein at least a second portion of the fins extend from the second planar surface of the primary extension;

one or more LEDs coupled to the outer planar surface of the secondary extension.

11. The LED luminaire of claim 10, further comprising a hollow channel formed substantially in the center of the modular heat sink, a wall of the hollow channel comprising a plurality of bases of the plurality of heat sink sections, wherein the hollow channel extends longitudinally through the modular heat sink.

12. The LED luminaire of claim 11, further comprising:

a wireway tube comprising a first end and a second end and a passageway therebetween, the first end coupled to the channel; and a mounting plate coupled to the second end of the wireway tube.

13. The LED luminaire of claim 11, further comprising one or more drivers, each driver configured to electrically control one or more of the LEDs.

14. The LED luminaire of claim 10, wherein each heat sink section further comprises:

a first outer extension comprising a substantially planar member coupled to the first longitudinal edge of the secondary extension and extending radially outward from the secondary extension at an angle;

a second outer extension comprising a substantially planar member coupled to the second longitudinal edge of the secondary extension and extending radially outward from the secondary extension at an angle; and a plurality of fins coupled to the first outer extension and extending radially inward at a second angle; and a plurality of fins coupled to the second outer extension and extending radially inward at the second angle.

15. The LED luminaire of claim 14, wherein the angle is an orthogonal angle and wherein the second angle is an acute angle.

16. The LED mounting structure of claim 14, wherein each of the first outer extension and the second outer extension comprises an outer planar surface disposed along an outer perimeter of the modular heat sink and facing radially outward, wherein each outer planar surface of the first outer extension and the second outer extension is reflective.

17. The LED mounting structure of claim 14, wherein the angle ranges from about ninety degrees to about 180 degrees and wherein the second angle is a substantially orthogonal angle.

18. The LED mounting structure of claim 14, further comprising:

a first connector coupled to the first outer extension and positioned at a distal end from the secondary extension; and a second connector coupled to the second outer extension and positioned at a distal end from the secondary extension;

wherein the first connector of each heat sink section is interconnected with the second connector of an adjacent heat sink section.

19. The LED mounting structure of claim 10, wherein at least a portion of the outer surface of the modular heat sink is configured to be positioned outside the thermal perimeter of the modular heat sink.

* * * * *